US005735321A

United States Patent [19]

Martyn et al.

[11] Patent Number: 5,735,321

[45] Date of Patent: Apr. 7, 1998

[54] ISOLATOR SYSTEM

[75] Inventors: Ryder Martyn, Rastrick; Neil Graham Cocker, Flockton, both of Great Britain

[73] Assignee: Extract Technology Ltd., Huddersfield, England

[21] Appl. No.: 504,851

[22] Filed: Jul. 20, 1995

[51] Int. Cl.[6] ..... B65B 1/04

[52] U.S. Cl. ..... 141/383; 141/114; 141/97; 141/83; 414/292

[58] Field of Search ..... 141/383, 97, 98, 141/390, 319–322, 83, 364, 365, 366, 375, 376, 386, 114; 414/292; 454/63, 56; 600/21

[56] References Cited

U.S. PATENT DOCUMENTS 3,536,370 10/1970 Evans et al. ..... 600/21
4,669,950 6/1987 St. Lawrence ..... 141/97
5,263,521 11/1993 Brossard et al. ..... 141/384
5,484,004 1/1996 Bolz ..... 141/319

*Primary Examiner*—Henry I. Recla
*Assistant Examiner*—Steven O. Douglas
*Attorney, Agent, or Firm*—Madson & Metcalf

[57] ABSTRACT

An isolator system 10 comprises an isolator 11 moveably mounted on a support 12 and an impervious bag 16 open at one end and sealingly attachable to the isolator 11. A drum 90 containing a substance to be dispensed may be sealingly attached to the isolator by moving the isolator to the drum. The lid 110 of the drum 90 may be removed from the drum once the lidded end of the drum is within the isolator 11. The isolator is able to rotate about the axis of its support which causes inversion of the isolator and the drum now contained within the isolator. Substances contained within the drum may be dispensed into a second container such as an IBC whilst contained within the enclosure thus protecting an operator from contamination from the substance.

10 Claims, 11 Drawing Sheets

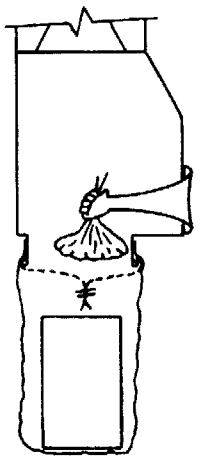
FIG. 24
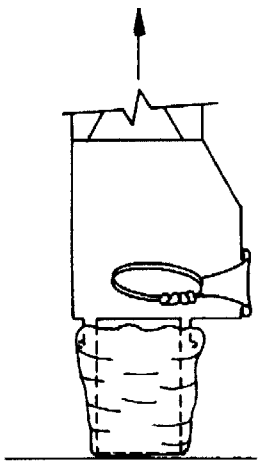
FIG. 23
FIG. 20
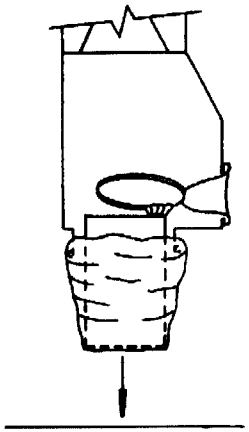
FIG. 21
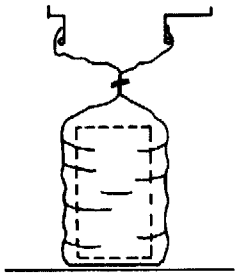
FIG. 22
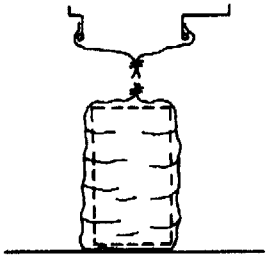

ISOLATOR SYSTEM

BACKGROUND TO THE INVENTION

This invention relates to an isolator system of the type used to isolate toxic and/or pharmaceutical substances during handling.

Many toxic and/or pharmaceutical substances are provided by a manufacturer in large drums. A company buying the substances from a manufacturer will require to either sub-divide the drum for production, discharge the drum contents direct to the process or dispense the substance(s) to a transport container of some kind.

The large drum will generally be sealed with a lid and clamp, whilst the contents may be loose within the drum or sealed within single/double tied drum liners.

The transport container is known as a High Containment Transit Container (HCTC) which is suitable for use with smaller quantities or an Intermediate Bulk Container (IBC) which is suitable for use with large quantities or when blending of various compounds is to take place prior to further stages of the final products production process.

Clearly, when the substance is highly toxic or is a pharmaceutical substance which may have other undesirable effects, it is of vital importance to protect the operators handling the material from exposure to the substance.

It is known to use a container known as an isolator to contain toxic substances and to handle the toxic substances within the container. Generally an isolator will be fixed to, for example, a wall of a room in which the isolator is positioned, and an operator will have access to objects placed within the isolator by means of gloves extending into the isolator through glove ports.

However, a problem exists at the point where substances are transferred from large drums to HCTC's, IBC's or direct to the process system.

It is known to use, for example, a vacuum system to transfer substances from a large drum into a container within an isolator. The substance will be transferred into the container placed in the isolator using the vacuum system. Whilst the process of using a vacuum system generally prevents contamination of the surroundings by the toxic substance, after use, the vacuum system must be cleaned before being used for a subsequent job, and at this point contamination may occur.

It is also known to meter out a substance contained in a vacuum from a position outside an isolator and to introduce the substance into a hopper which will then feed the substance into the isolator. Clearly, because the drum, operator and hopper are positioned outside the isolator, potential contamination and poisoning of the operator may occur.

SUMMARY OF THE INVENTION

According to a first aspect of the invention there is provided a moveable enclosure adapted to isolate substances contained within the enclosure from their surroundings.

According to a second aspect of the invention there is provided an isolator system, the system comprising:

- a first container having a removable lid positioned at a lidded end of the first container;
- a second container having an open end;
- a fluid tight moveable enclosure into which at least the lidded end of the first container is sealingly enclosable.

According to a third aspect of the invention there is provided a method of dispensing a material from a first container having a removable lid positioned at a lidded end of the container and into a second container comprising the steps of:

- sealingly enclosing at least the lidded end of the first container within a fluid tight moveable enclosure;
- enclosing at least an open end of the second container within the moveable enclosure;
- removing the lid of the first container whilst sealingly enclosed within the enclosure;
- inverting at least the first container to allow material to flow from the first container, and dispensing the material from the first container into the second container.

Advantageously the first container comprises a drum.

Known enclosures, for example, isolators described hereinabove are known to be fixed to a support, for example, a wall of a room containing the isolator. As such operations requiring interaction with the enclosure may be awkward and limited. By means of the present invention, an enclosure or isolator may be moved towards a drum containing a substance to be handled. This obviates the need to move the drum to the isolator, which drum may be very heavy when full of the substance to be handled.

The enclosure may comprise a tubular length of an impervious material, for example, a plastics material. The tubular length of material may be sealingly attached to the lidded drum at one end, and then sealingly attached to a material dispenser in the form of, for example, a material feed tube at the other end. The lid of the drum may then be removed by, for example, using a glove extending into the tube, or by merely making use of excess material conveniently incorporated into the length of tube.

Advantageously, the material feed tube comprises a valve, for example, an iris valve.

Once the lid of the drum has been removed, the system may be inverted such that the open drum is inverted and material may exit from the open end of the drum. The valve prevents material from exiting from the system until required.

A container such as an IBC may be sealingly connected to an end of the material feed tube, and metered doses of the material may be fed into the IBC by means of the valve. When the dispensing process has been completed, the tubular length of material may be used to seal the now empty drum which may then be disposed in the usual way.

Advantageously, the enclosure comprises an isolator movably mounted on a support.

The support is preferably an elongate member, and the isolator is attached to the support in a manner which allows movement in a direction along an axis substantially parallel to the axis of the support.

The drum is also moveable rotationally substantially around the axis of the support, and rotationally around an axis substantially at right angles to the support.

In use, the movement of the drum along an axis substantially parallel to the axis of the support allows the isolator to be moved into sealing engagement with the drum. Whilst the drum remains sealed, the drum may be incorporated into the isolator.

The system further comprises an impervious tubular component which may be sealingly attached to the isolator and also to the drum. The tubular component allows the drum to be introduced within the container. Once the drum is positioned within the isolator, the isolator may be sealed.

Advantageously, the isolator further comprises one or more glove ports allowing access to the inside of the isolator by means of gloves attached to the glove ports. The drum may be manipulated within the container via the glove port.

Once within the isolator, the lid of the drum may be removed by using, for example, the glove ports.

Conveniently, the isolator further comprises feed means for feeding the material within the drum into a second container.

The drum may be manipulated within the container by means of the glove ports or, for example, by means of a clamp positioned within the container. The open end of the drum may be brought into sealing contact with the material feeder. The isolator may then be rotated about an axis substantially at right angles to the axis of the elongate support member in effect inverting the open drum to allow dispensing of the material within the drum.

Preferably, the material feeder comprises a valve which prevents flow of the material until required.

Advantageously, the system further comprises a weigh platform onto which a further container, for example, an IBC may be positioned. The isolator may be sealingly attached to the IBC by means of a door access. Material within the drum may now be dispensed in measured amounts into the IBC by means of the material feeder.

Advantageously the system further comprises a sensor for sensing, for example, when the weight of the IBC has reached a predetermined value and for shutting the valve at that point.

Advantageously, the system further comprises a feed pipe attachable to the material feeder. Once the IBC is in position, the door access may be removed allowing connection of the feed pipe into the IBC.

The invention will now be further described by way of example only with reference to the accompanying drawings in which:

INTRODUCTION TO THE DRAWINGS

FIGS. 8 to 24 are schematic representations showing use of the isolator of FIGS. 1 to 3;

DESCRIPTION OF PREFERRED EMBODIMENTS

Figure 3:
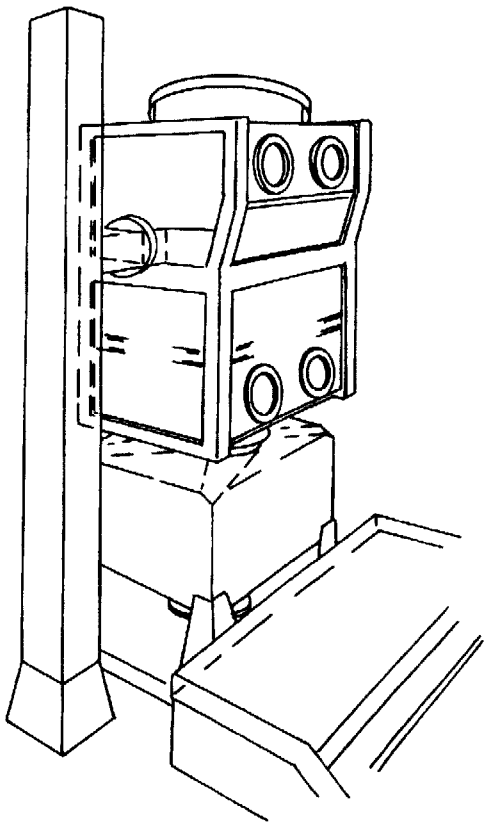
FIGS. 1 to 3 are schematic representations of an embodiment of an isolator system in accordance with an aspect of the present invention.
Figure 2:
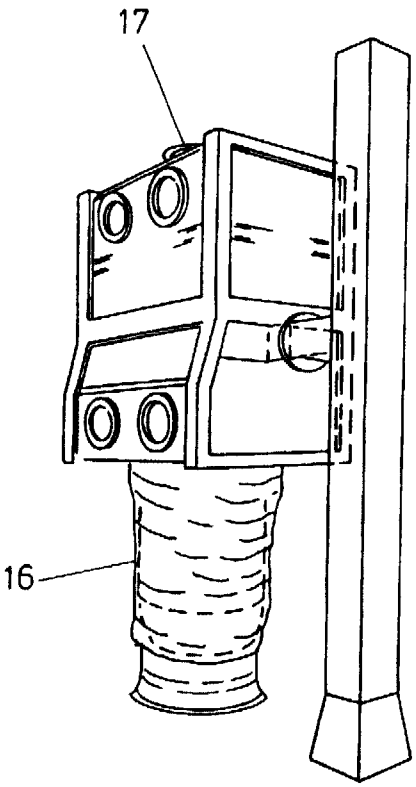
Figure 1:
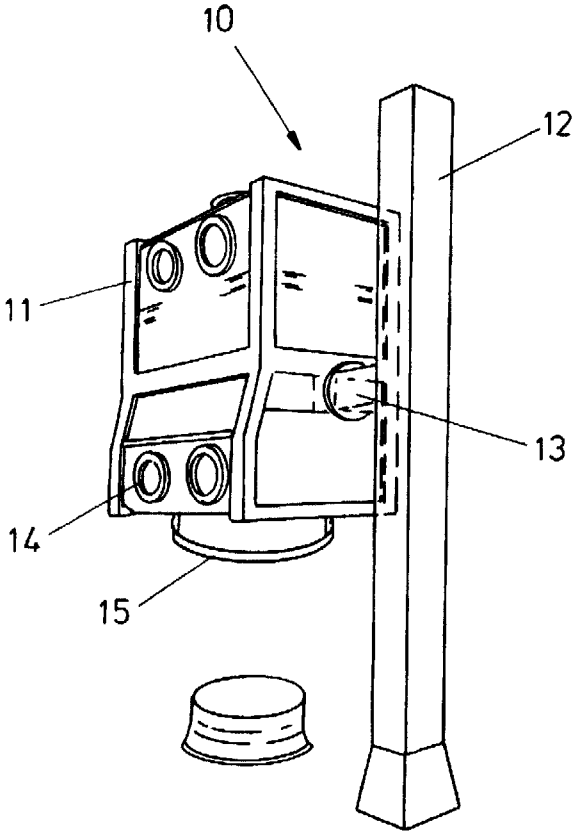

Referring to FIGS. 1 to 3 an embodiment of the present invention comprising an isolator system is designated generally by the reference numeral 10. The isolator system 10 comprises an isolator 11 movably mounted on a support 12. The support 12 comprises an elongate member in the form of a lift unit and further comprises a support arm 13 positioned substantially perpendicular to the elongate member 12. The isolator 11 is mounted to allow movement along an axis substantially parallel to the axis of the elongate member 12. The isolator 11 is also able to rotate about the axis of arm 13 and also about the axis of elongate member 12.

The isolator comprises glove ports 14 sealingly attached to which are gloves (not shown) allowing an operator protected access to the inside of the container. The glove ports and gloves allow anything positioned within the isolator to be handled without risk of contamination.

The isolator comprises an aperture 15 which allows sealing connection to a drum.

The system further comprises an impervious bag 16 open at one end (top) which may be sealingly attached to the aperture 15. The system 10 comprises a second sealed aperture 17.

Figure 4:
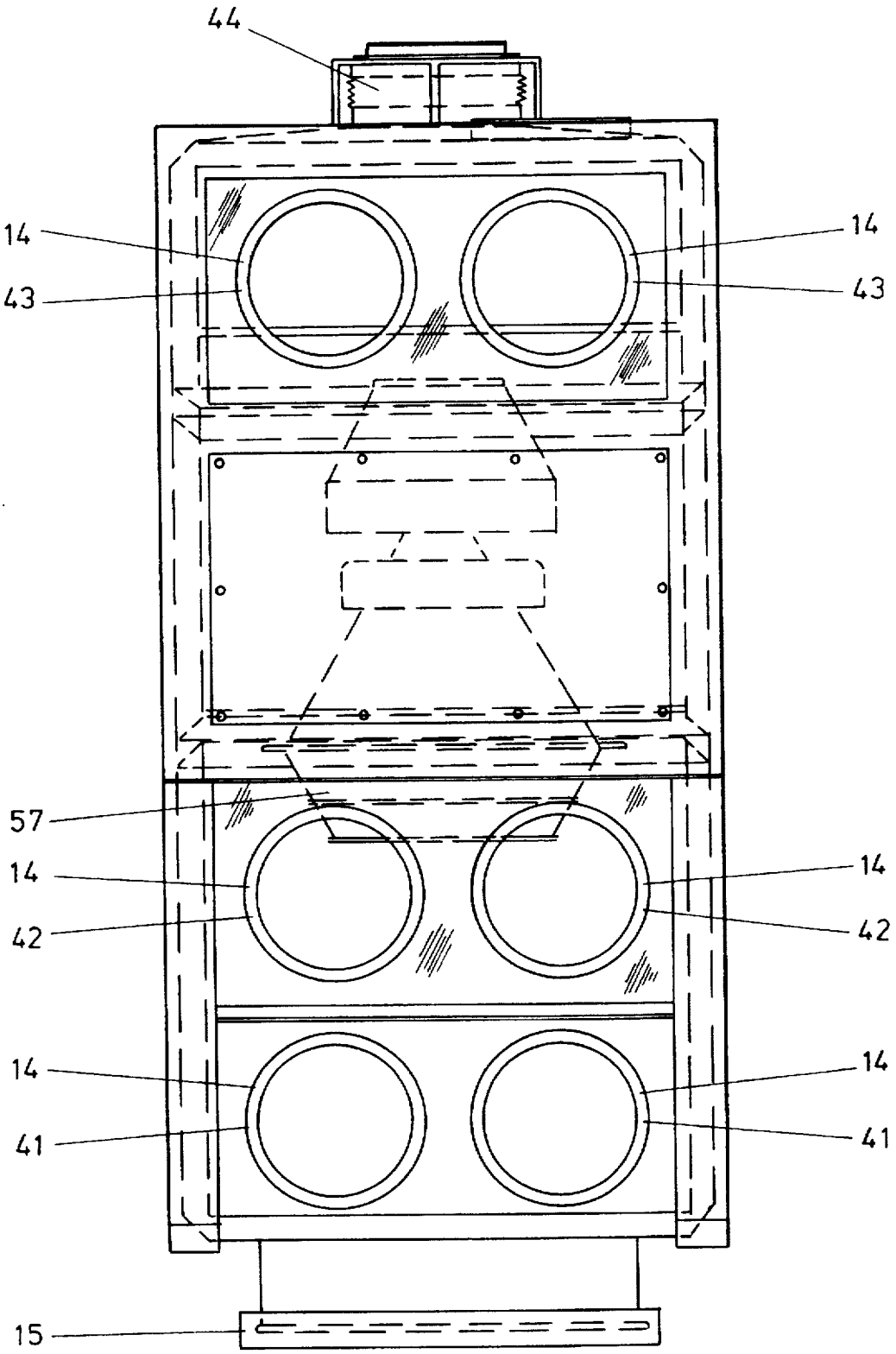
FIG. 4 is a schematic representation of a front elevation of the isolator of FIGS. 1 to 3.
Figure 5:
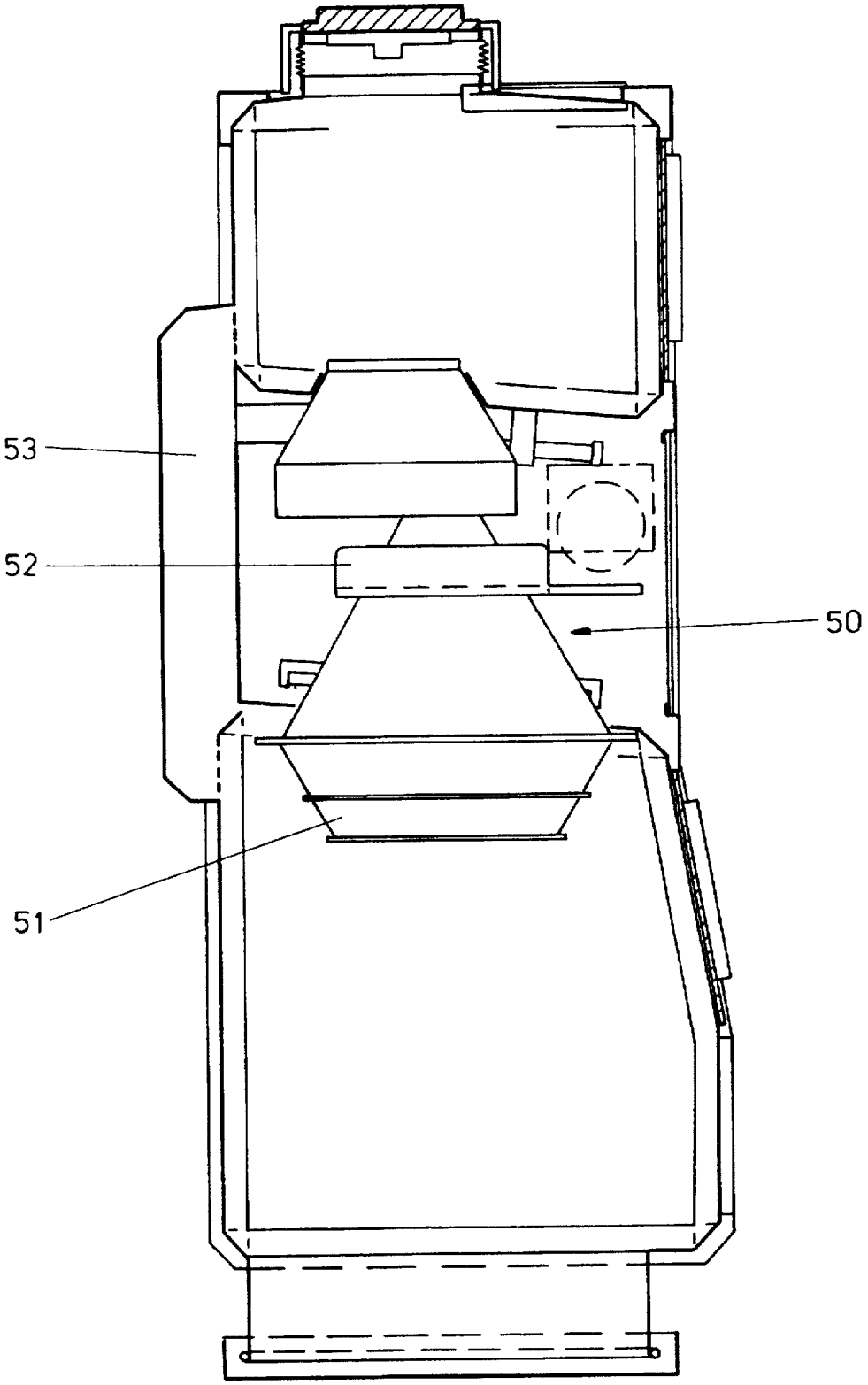
FIG. 5 is a cross sectional representation of the isolator of FIG. 4 taken along line X—X of FIG. 4.
Figure 6:
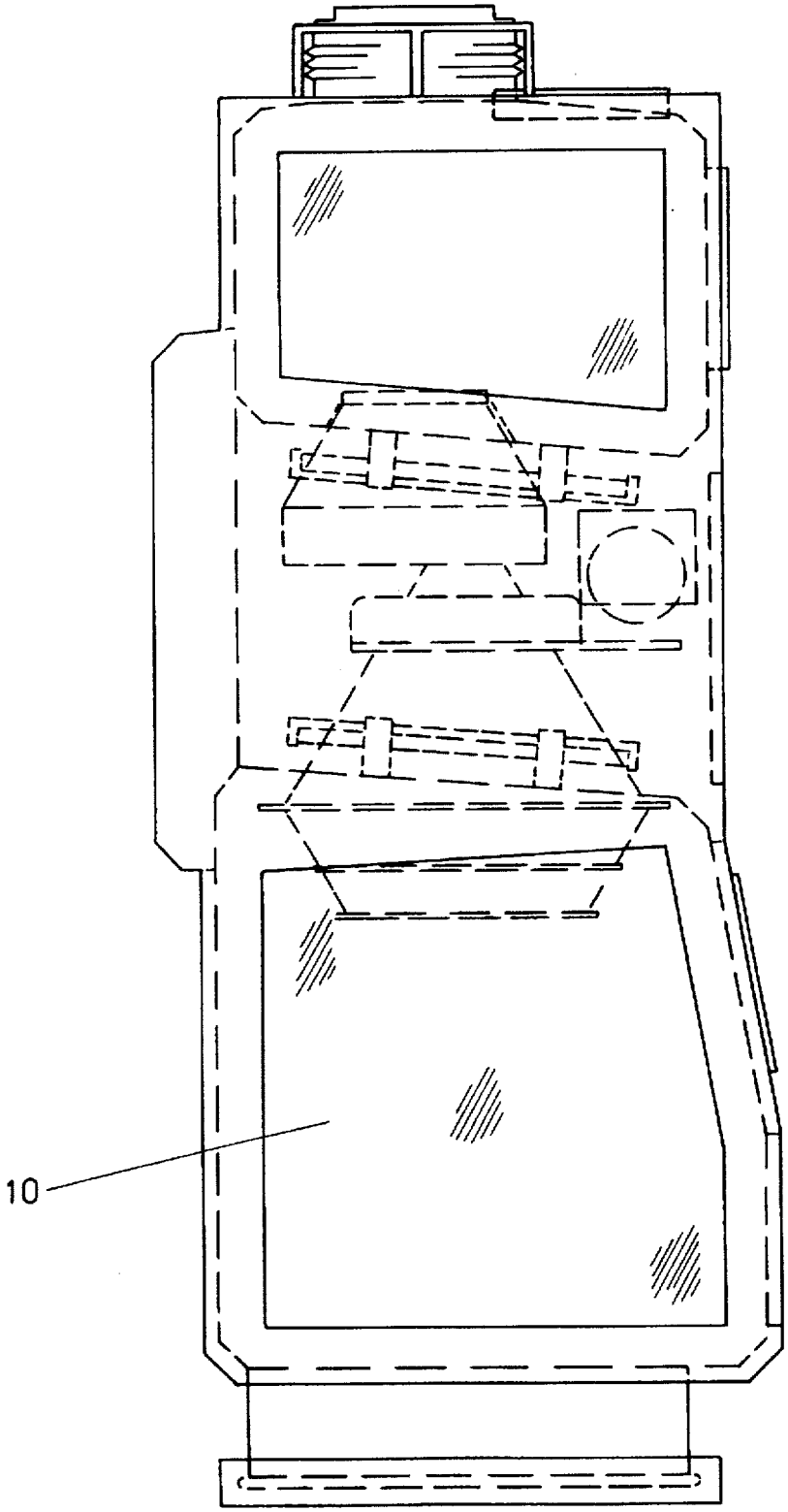
FIG. 6 is a side elevation of the isolator shown in FIGS. 1 to 3.
Figure 7:
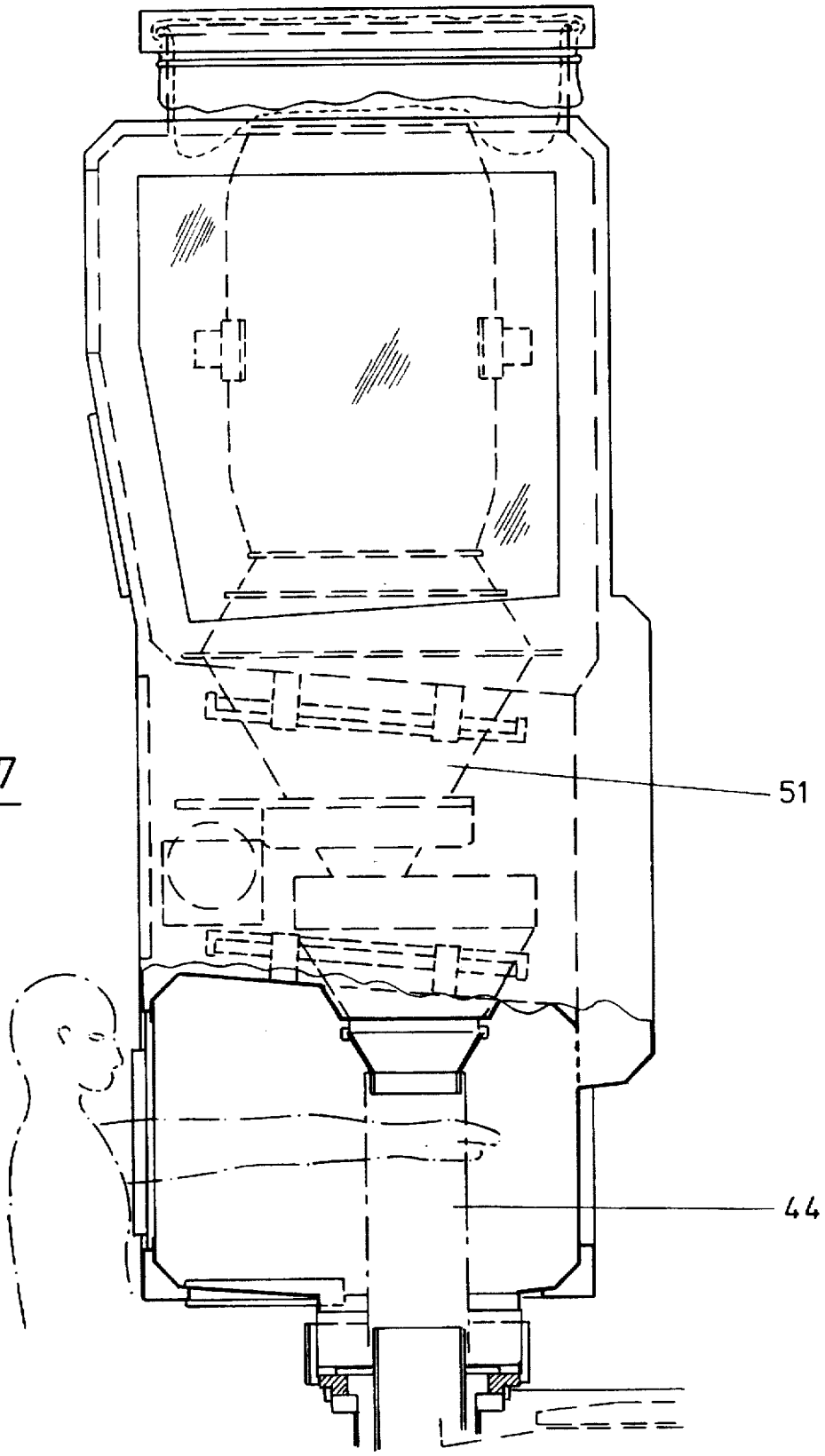
FIG. 7 is a side elevation of the isolator of FIGS. 1 to 3 in the discharge position.
Figure 11:
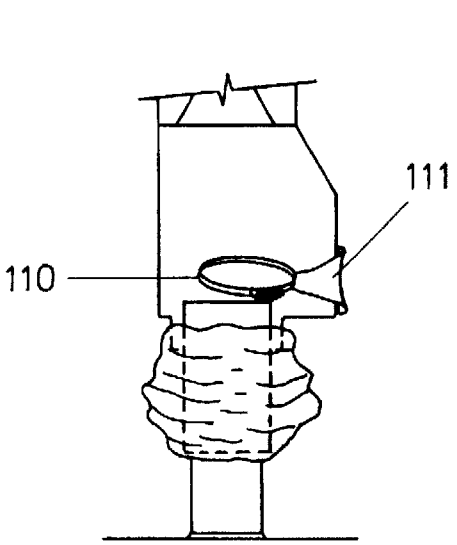
Figure 10:
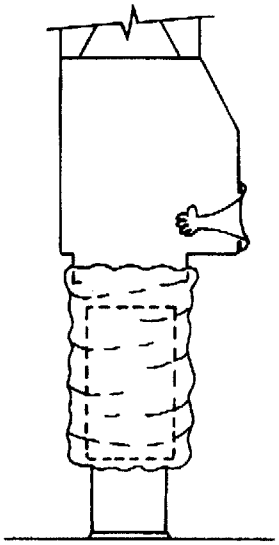
Figure 9:
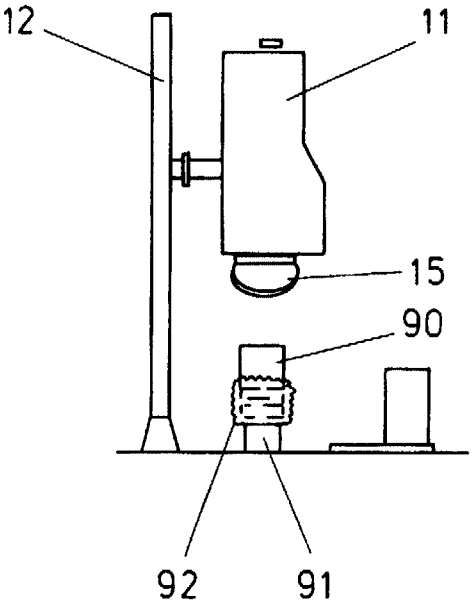
Figure 8:
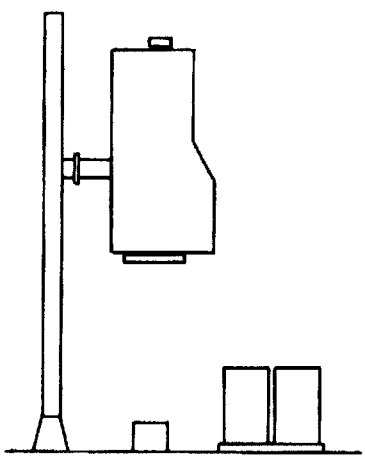
Figure 15:
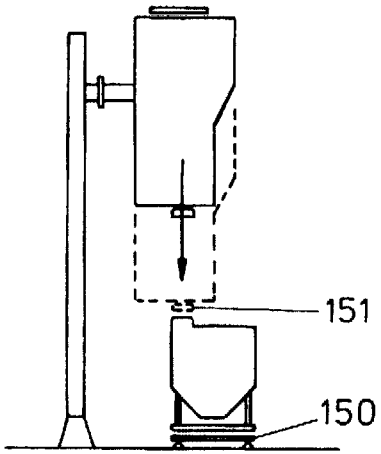
Figure 14:
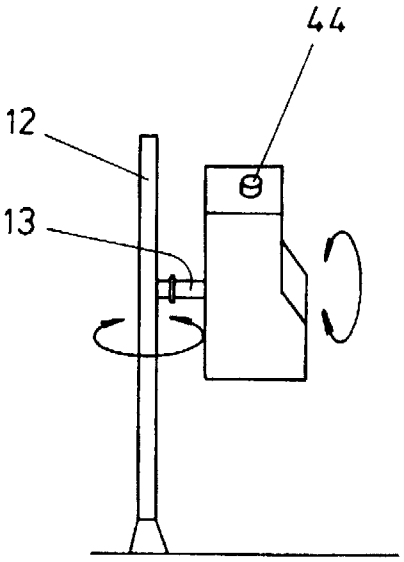
Figure 13:
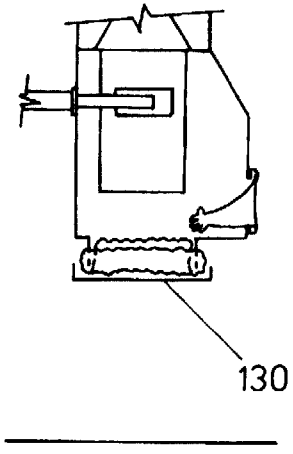
Figure 12:
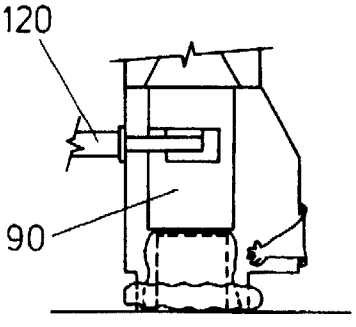
Figure 19:
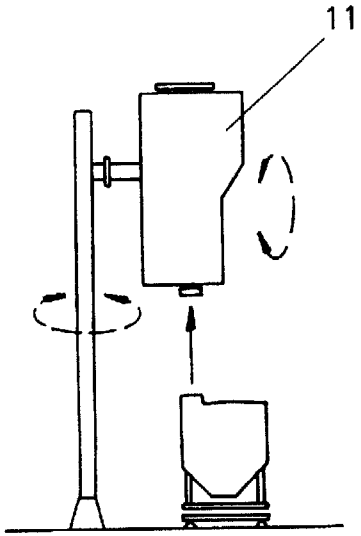
Figure 18:
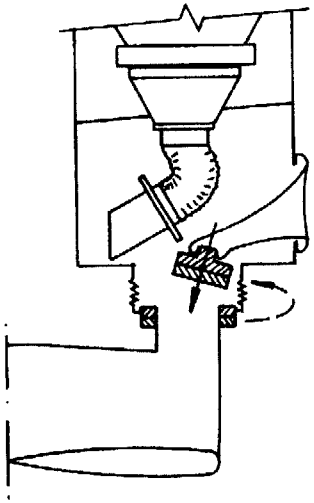
Figure 17:
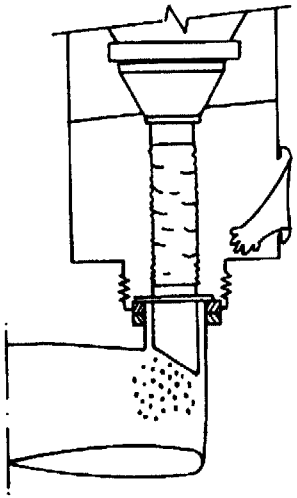
Figure 16:
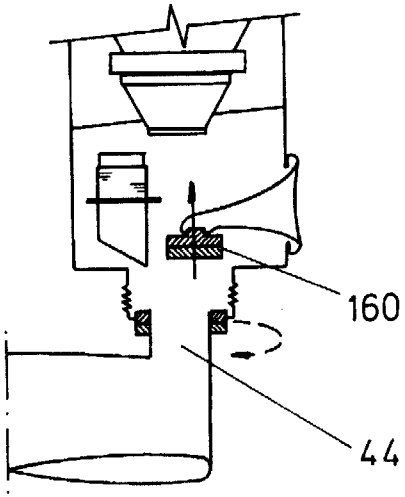

Referring to FIGS. 4, 5 and 6 the components of the system 10 are shown in more detail. As can be seen particularly in FIG. 5, the isolator contains a material feeder designated generally by the reference numeral 50. The material feeder comprises a cone 51 having associated with it a valve 52. The system further comprises an exhaust plenum 53 for allowing removal of waste. The cone 51 may be adapted to suit the size of a drum to be handled by the isolator system 10.

As can be seen best in FIG. 4, the isolator 10 in the present example comprises six glove ports 14. The glove ports 41 allow access to the aperture 15. Glove ports 42 allow access to the cone 51 and glove ports 43 allow access to a feed chute 44 attachable to the cone 54.

With particular reference now to FIGS. 8 to 24, operation of the isolator system 10 will be described in more detail.

The isolator system is particularly useful for dispensing toxic and/or pharmaceutical substances contained initially in a drum, into a second container typically an IBC. A drum 90 containing the substance to be dispensed is positioned on a floor pedestal 91 positioned below the isolator 11 supported by support 12. The drum is contained within a bag 92, formed from, for example, a plastics material. Alternatively, the drum 90 may be positioned directly onto the floor.

The isolator 11 is moved down towards the drum 90 until it is substantially in contact with the drum 90. The bag 92 is then moved to completely surround the drum and to make sealing contact with the aperture 15 of the isolator 11. At this point, the drum may be introduced completely into the isolator. Once the lidded end of the drum is within the isolator 11, the lid 110 may be removed from the drum by an operator who gains access to the isolator 11 by means of a glove 111 attached to a glove port 14.

The drum 90 may comprise liners which will require opening and folding back prior to engagement with the cone 51.

A clamp 120 is then positioned around the drum 90 and is used for further manipulation of the drum 90. The drum 90 is brought into engagement with cone 51 attached to valve 52. Once the drum 90 is engaged with the cone 51, the bag 92 is brought within the isolator 11 to eliminate contamination to the surroundings. A closure 130 is then inserted over the aperture 15 to completely isolate the contents of the isolator 11 from its surroundings.

The isolator is then caused to rotate about the axis of arm 13 effectively inverting the isolator and the drum contained within the isolator. The isolator is also caused to rotate about the axis of elongate member 12 to move the isolator away from the floor pedestal 91 and into a different area. The isolator 11 may thus be moved over a weigh platform 155 on which is positioned an IBC into which the substance contained in the drum 90 is to be transferred.

The IBC 150 is sealingly connected to the isolator 11 by means of a second aperture 44 of the isolator 11 which is brought into sealed engagement with an aperture 151 of the IBC 150.

Once this connection has been made, a closure 160 associated with the aperture 44 is removed by means of an operator gaining access via a glove port and a glove. A flexible feeder 44 is then attached to the cone 51 and extends through aperture 44. Substances contained in the drum may now be dispensed into the IBC. The valve may be controlled by a sensor which accurately measures the weight of the IBC positioned on the weigh platform.

Once dispensing has been completed with either a completely empty or partially empty drum, the feed pipe is removed from the aperture 44 by the gloved operator and the closure is positioned within the aperture again.

The isolator 11 may then be re-positioned by rotating around axis 13 and also axis 12. By moving the isolator in this way, the drum is returned to its upright position with the open end facing upwards. The lid may then be returned to the drum by the gloved operator before the drum is inserted completely into the bag and the bag tied to seal the drum within the bag. The bag is preferably tied by two ties spaced apart from one another, and the bag is cut between the two ties. This results in the drum being sealed within the bag, allowing for subsequent disposal of the drum. In addition, the isolator is sealed from its surroundings.

When it is required to repeat the operation with a second drum, or with a partially empty drum a new drum bag may be attached around the aperture, allowing subsequent removal of the remains of the old bag.

The isolator 11 forming part of the system according to the present invention may be easily and conveniently moved to any area desired, for example, a clean area. This is achieved by virtue of the way in which the isolator 11 is fixed to the support to allow movement as described above.

The system according to the present invention significantly reduces the level of contamination into the surrounding area in particular, once the drum has been open, it is never then exposed to the surroundings.

Figure 25:
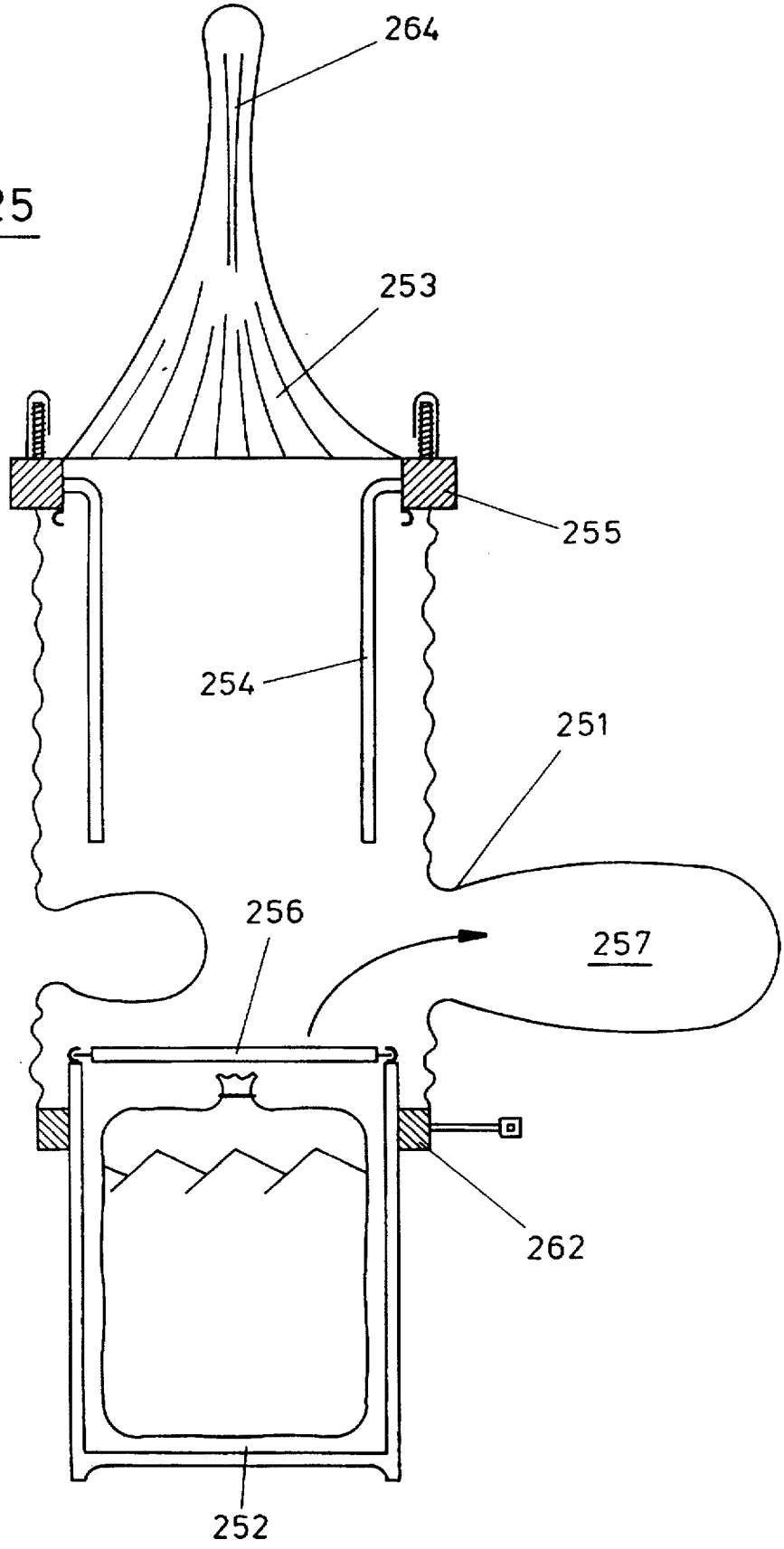
FIGS. 25 and 26 are schematic representations of a second embodiment of the present invention.
Figure 26:
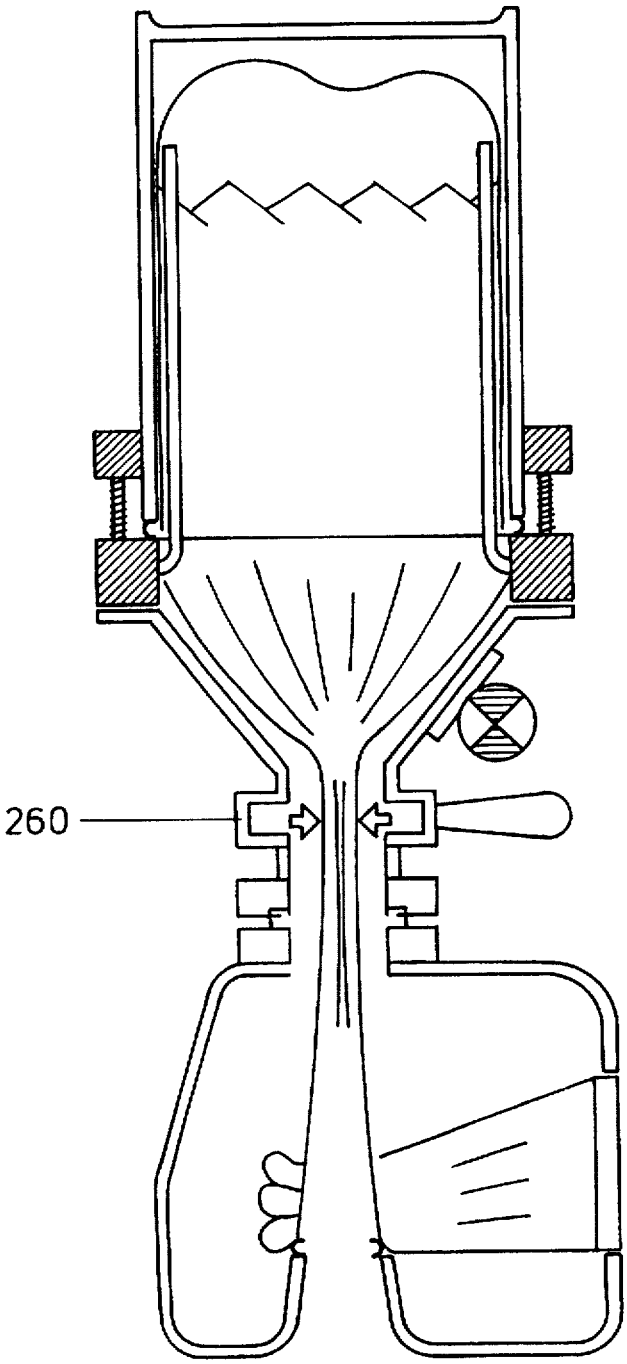

Referring now to FIGS. 25 and 26 a second embodiment of the invention is designated generally by the reference numeral 250. The second embodiment of the invention is a disposable form of the first embodiment of the invention.

The system comprises a flexible tubular enclosure of an impervious material, for example, a plastics material. The tubular enclosure 251 is attached via an air tight clamp to a drum 252 containing the material to be dispensed, and a material feed tube 253 at the opposite end. Attached to the material feed tube 253 is a support 254. The tube 251 is attached to the material tube feed 253 by means of an air tight clamp in the form of a band 262. Once the tubular enclosure 251 has been attached to the drum, the lid 256 of the drum may be removed by making use of the excess material which exists in the tubular enclosure 251 which allows an operator to place his or her hands in a fold formed from excess material and to use this to remove the drum clamp and lid 256. The lid 256 may be positioned in another area 257 formed from excess material. Once the lid has been removed the inner liner within the drum may be opened and folded back. At this point a second air tight clamp in the form of a band 255 with support 254 in the form of projecting legs, may be lowered into the exposed material and fixed by means of an external clamp to the mouth of the opened drum.

The whole system may then be inverted allowing material substance from the drum 252 to flow into the material feed tube 253. The system further comprises a valve 260, for example, an iris valve which controls flow of the material out of the material feed tube. A container or process vessel is sealingly attached to an end 264 of the material feed tube and material may be dispensed out of the drum in a controlled manner via the valve.

At the end of the dispensing operation the feed tube 253 may be disconnected by effecting a double tie of severing the intermediate section.

We claim:

1. An isolator system comprising:

a first container having a removable lid positioned at a lidded end of the container;

an isolator having a first sealable aperture to allow sealing attachment to the first container;

a second sealable aperture to allow sealing attachment to a second container;

access means to allow protected access to the inside of the isolator;

an impervious bag open at one end, the first container being positionable within the bag, and the open end of the bag sealingly connectable with the first aperture of the isolator thus sealingly attaching the first container to the isolator.

2. A system according to claim 1 wherein the first container comprises a drum.

3. A system according to claim 1 further comprising a material dispenser sealingly attachable to the isolator via the second sealable aperture of the isolator.

4. A system according to claim 3 wherein the material dispenser comprises a material feed tube.

5. A system according to claim 4 wherein the material feed tube comprises a valve.

6. A system according to claim 1 wherein the isolator is moveably mounted on a support.

7. A system according to claim 6 wherein the support is an elongate member, and the isolator is attached to the support in a manner which allows movement in a direction along an axis substantially parallel to the axis of the support.

8. A system according to claim 1 further comprising a weigh platform positionable below the isolator onto which the second container may be positioned.

9. A system according to claim 1 further comprising a feed pipe attachable to the material feeder.

10. A method of dispensing a material from a first container having a removable lid positioned at a lidded end of the container and into a second container, comprising the steps of:

sealingly enclosing the first container within a fluid tight impervious bag;

enclosing the second container within the impervious bag;

removing the lid of the first container whilst sealingly enclosed within the impervious bag;

inverting at least the first container to allow material to flow from the first container, and dispensing the material from the first container into the second container.

* * * * *

UNITED STATES PATENT AND TRADEMARK OFFICE

CERTIFICATE OF CORRECTION

PATENT NO : 5,735,321
DATED : April 7, 1998
INVENTOR(S) : Martyn Ryder and Neil Graham Cocker It is certified that error appears in the above-identified patent and that said Letters Patent is hereby corrected as shown below:

On the title page: Item [19] : Ryder et al.

Item [75] of the cover page, please replace "Ryder Martyn" with --Martyn Ryder--.

Please insert the foreign priority claim under Section 119 of Title 35 of the United States Code to United Kingdom Patent Application No. 9414641.2 dated July 20, 1994.

Signed and Sealed this

Twenty-third Day of June, 1998

*Attest:*

BRUCE LEHMAN

*Attesting Officer*

*Commissioner of Patents and Trademarks*